US009902508B2

(12) United States Patent
Py

(10) Patent No.: US 9,902,508 B2
(45) Date of Patent: Feb. 27, 2018

(54) DELIVERY DEVICE WITH SEPARATE CHAMBERS CONNECTABLE IN FLUID COMMUNICATION WHEN READY FOR USE, AND RELATED METHOD

(71) Applicant: Dr. Py Institute LLC, New Milford, CT (US)

(72) Inventor: Daniel Py, Larchmont, NY (US)

(73) Assignee: DR. PY INSTITUTE LLC, New Milford, CT (US)

( * ) Notice: Subject to any disclaimer, the term of this patent is extended or adjusted under 35 U.S.C. 154(b) by 310 days.

(21) Appl. No.: 14/637,050

(22) Filed: Mar. 3, 2015

(65) Prior Publication Data

US 2015/0225095 A1 Aug. 13, 2015

Related U.S. Application Data

(62) Division of application No. 11/804,431, filed on May 18, 2007, now Pat. No. 8,967,374.
(Continued)

(51) Int. Cl.
*B65B 3/00* (2006.01)
*A61J 7/00* (2006.01)
(Continued)

(52) U.S. Cl.
CPC ..... *B65B 3/003* (2013.01); *A61J 1/2093* (2013.01); *A61J 7/0053* (2013.01);
(Continued)

(58) Field of Classification Search
CPC ..... A61J 1/2027; A61J 1/2093; B65B 3/003; B01F 11/0065
See application file for complete search history.

(56) References Cited

U.S. PATENT DOCUMENTS 3,608,709 A 9/1971 Pike
3,651,615 A 3/1972 Bohner et al.
(Continued)

FOREIGN PATENT DOCUMENTS

WO WO 89/02730 4/1989
WO WO 0119448 A1 3/2001

OTHER PUBLICATIONS

International Search Report and Written Opinion of the International Searching Authority for International Application No. PCT/US2007/11983.

*Primary Examiner* — Laura Bouchelle
(74) *Attorney, Agent, or Firm* — McCarter & English, LLP

(57) ABSTRACT

A device and method are provided for storing substances separately, and for mixing the substances prior to use. The device defines at least one first chamber for receiving a first substance, and at least one second chamber for receiving a second substance. A first sealing portion is located between the first and second chambers and is movable between a closed position preventing fluid communication between the chambers, and an open position permitting fluid communication between the first and second chambers for mixing the substances. First and second penetrable and resealable portions in fluid communication with the first and second chamber(s), respectively, may be used for filling by penetrating them with an injection member and introduce the substances therethrough and into the respective chamber, and resealing the injection apertures and the substances within the respective chamber.

31 Claims, 7 Drawing Sheets

Related U.S. Application Data

(60) Provisional application No. 60/801,978, filed on May 18, 2006.

(51) Int. Cl.

| | |
|---|---|
| ***B01F 11/00*** | (2006.01) |
| ***B01F 15/02*** | (2006.01) |
| ***B65D 75/52*** | (2006.01) |
| ***B65D 81/32*** | (2006.01) |
| ***B67D 3/00*** | (2006.01) |
| ***A61J 1/20*** | (2006.01) |
| *A61J 1/10* | (2006.01) |

(52) U.S. Cl.

CPC ..... *B01F 11/0065* (2013.01); *B01F 15/0205* (2013.01); *B01F 15/0212* (2013.01); *B01F 15/0223* (2013.01); *B65D 75/527* (2013.01); *B65D 81/3266* (2013.01); *B67D 3/0012* (2013.01); *B67D 3/0019* (2013.01); *B67D 3/0061* (2013.01); *A61J 1/10* (2013.01); *A61J 1/2027* (2015.05)

(56) References Cited

U.S. PATENT DOCUMENTS

| | | | |
|---|---|---|---|
| 3,877,877 | A | 4/1975 | Prosen |
| 4,198,972 | A | 4/1980 | Herb |
| 4,364,474 | A | 12/1982 | Hollander, Jr. |
| 4,537,308 | A | 8/1985 | Hollander, Jr. |
| 4,548,606 | A | 10/1985 | Larkin |
| 4,557,377 | A | 12/1985 | Maloney |
| 4,608,043 | A | 8/1986 | Larkin |
| 4,632,244 | A | 12/1986 | Landau |
| 4,927,012 | A | 5/1990 | Rowe |
| 4,952,068 | A | 8/1990 | Flint |
| 4,997,083 | A | 3/1991 | Loretti et al. |
| 5,114,004 | A | 5/1992 | Isono et al. |
| 5,176,634 | A | 1/1993 | Smith et al. |
| 5,226,878 | A | 7/1993 | Young |
| 5,267,646 | A | 12/1993 | Inoue et al. |
| 5,373,966 | A | 12/1994 | O'Reilly et al. |
| 5,423,421 | A | 6/1995 | Inoue et al. |
| 5,465,767 | A | 11/1995 | Harms et al. |
| 5,853,388 | A | 12/1998 | Semel |
| 6,036,005 | A | 3/2000 | Krause et al. |
| 6,996,951 | B2 | 2/2006 | Smith et al. |
| 7,040,483 | B2 | 5/2006 | Inuzuka et al. |
| 2004/0118710 | A1 | 6/2004 | Bourque et al. |
| 2005/0128866 | A1 | 6/2005 | Su |

DELIVERY DEVICE WITH SEPARATE CHAMBERS CONNECTABLE IN FLUID COMMUNICATION WHEN READY FOR USE, AND RELATED METHOD

CROSS REFERENCE TO RELATED APPLICATIONS

This patent application is a divisional of U.S. patent application Ser. No. 11/804,431, entitled "Delivery Device With Separate Chambers Connectable In Fluid Communication When Ready For Use, And Related Method," now U.S. Pat. No. 8,967,374, which claims benefit of U.S. provisional patent application Ser. No. 60/801,978, filed May 18, 2006, entitled "Delivery Device With Separate Medicament And Beverage Chambers Connectable In Fluid Communication When Ready For Use, And Related Method," all of which are hereby expressly incorporated by reference as part of the present disclosure.

FIELD OF THE INVENTION

The present invention relates to delivery devices and related methods, and more particularly, to delivery devices including first chambers for containing medicaments or other desired substances and second chambers for containing beverages or other desired substances that are connectable in fluid communication with respective first chambers when ready for use to mix the medicaments and beverages or other desired substances prior to delivery, and to related methods of making and using same.

BACKGROUND INFORMATION

Optimized pH and local enzymatic metabolisms (e.g., metabolizing and transporting enzymes) can be critical to the absorption and activity of a specific drug or medicament. It is well known that drug metabolizing and drug transporting enzymes can be enhanced or inhibited within the lining of the gut wall. For example, it has been shown that grapefruit can inhibit the absorption of many drugs up to 8 to 12 hours after intake. Similarly, milk has been shown to reduce absorption and transportation of some antibiotics. Many foods likewise decrease the rate of absorption of acetaminophen and thereby reduce its analgesic affect. However, some beverages have been known to speed up the rate of absorption of acetaminophen and thereby increase its analgesic affect.

Many drugs or medicaments are not well tolerated when administered enterally. For example, aspirin, ibuprofen, and naproxen are known to irritate the stomach. In order address these problems, physicians may recommend that certain drugs be taken with food to improve tolerance. However, each drug has a specific pH of absorption, and the food intake recommended by a physician for improving tolerance can significantly alter the absorption, transport and/or bioavailability of the drug. For example, high fiber foods may bind to a drug and prevent its absorption. If the coating on a tablet or capsule is not subject to the appropriate environment, it may not dissolve as intended, thus causing the drug within the tablet or capsule, or a significant portion thereof, to pass directly to the feces. On the other hand, particularly in children, diarrhea may speed up the dissolution of tablets or capsules, and may thereby prevent the drug from achieving an expected therapeutic effect.

Although it would be desirable to mix drugs and beverages in the same packages or dispensers in order to enhance drug tolerance, and/or to enhance drug absorption, transport and/or bioavailability, many such drug/beverage combinations are not believed to be shelf stable, and/or are not approved for combination by the United States Food and Drug Administration ("FDA") or other applicable regulatory agencies.

Many reconstitution packages have been made in different fields of use, including pharmaceuticals. A typical reconstitution package allows the manufacturer to fill two different active ingredients in different compartments of a common package such that each compartment is approved for stability of the respective ingredient. This can be a significant advantage where the two active ingredients are not shelf stable when combined. Typically, the user mixes or "reconstitutes" the two active ingredients immediately prior to ingestion. The present inventor is not aware of any reconstitution packages including a drug or medicament in one compartment and a food or beverage in another compartment. One possible reason for this is that drugs, on the one hand, and foods and beverages, on the other hand, are subject to different regulatory requirements, such as those imposed by the FDA. Foods and beverages are frequently enriched solutions or suspensions, and in many cases have low levels of acidity, and thus frequently provide excellent media for bacterial and/or yeast growth. As a result, the FDA and other applicable regulatory agencies impose limited shelf life and period of use restrictions on such food and beverage products unless they are terminally sterilized. Terminal sterilization typically involves the application of radiation, such as gamma or ebeam radiation, or the application of heat, such as by retort. For many drugs, however, terminal sterilization is not possible because it would either destroy or damage the active ingredients. Accordingly, typically there are substantial differences between the aseptic processes and equipment used to manufacture drugs in comparison to those for foods and beverages. Similarly, there can be substantial differences in the FDA and other applicable regulations for the manufacture of drugs in comparison to those for foods and beverages.

Accordingly, it is an object of the present invention to overcome one or more of the above described drawbacks and/or disadvantages of the prior art.

SUMMARY OF THE INVENTION

In accordance with one aspect, the present invention is directed to a device comprising a body defining at least one first chamber for receiving therein a first substance, and at least one second chamber for receiving therein a second substance. In accordance with some embodiments of the present invention, the first substance is a drug or medicament, and the second substance is a food and/or beverage. A first sealing portion of the device is located between the first and second chambers and is movable between a closed position preventing fluid communication between the first and second chambers, and an open position permitting fluid communication between the first and second chambers for mixing the first and second substances when ready for use. A first penetrable and thermally resealable portion is in fluid communication with the first chamber, and is penetrable by an injection member to form an injection aperture therethrough and introduce the first substance through the injection member and into the first chamber, and is thermally resealable to seal the injection aperture and the first substance within the first chamber by applying energy thereto. A second penetrable and thermally resealable portion is in fluid communication with the second chamber, and is penetrable by an injection member to form an injection aperture therethrough and introduce the second substance through the injection member and into the second chamber, and is thermally resealable to seal the injection aperture and the second substance within the second chamber by applying energy thereto.

In one embodiment of the present invention, the device further comprises at least one dispensing port in fluid communication with at least one of the first and second chambers, and a sealing member movable between a closed position sealing the dispensing port, and an open position allowing the first and second substances to flow through the dispensing port. In one such embodiment, the dispensing port is frangibly connected to the body.

In one embodiment of the present invention, the body includes at least one substantially flexible portion defining at least one of the first and second chambers. In one such embodiment, the body includes a first substantially flexible portion, a second substantially flexible portion, at least one peripheral sealing portion extending between the first and second flexible portions and forming a fluid-tight seal therebetween, and at least one second sealing portion extending between the first and second flexible portions and substantially preventing fluid communication between the first and second chambers. In one such embodiment, the first sealing portion is formed within the second sealing portion. In one such embodiment, the first sealing portion is formed by a relatively weak sealing region of the second sealing portion. In one embodiment, the first sealing portion is defined by a frangible portion of the second sealing portion that is breakable in response to pressure in the first chamber and/or second chamber exceeding a substantially predetermined threshold pressure. In one such embodiment, the frangible portion is breakable by manually engaging and squeezing a flexible portion of the body. Preferably, the first sealing portion is selected from the group including (i) a frangible portion, (ii) a sealing portion defining a reduced seal thickness in comparison to contiguous sealing portions, (iii) a relatively weak wall portion, and (iv) a stopper received within an aperture connectable in fluid communication between the first and second chambers.

In one embodiment of the present invention, the body further defines at least one third sealing portion preventing fluid communication therethrough and extending between the first and second substantially flexible portions. The third sealing portion defines at least one of (i) a plurality of first chambers located on opposite sides of the third sealing portion relative to each other, and (ii) a plurality of second chambers located on opposite sides of the third sealing portion relative to each other. Preferably, the device defines a plurality of delivery devices, wherein each delivery device includes a respective first chamber, a respective second chamber, and a respective first sealing portion. In one such embodiment, the device further comprises a plurality of separable portions located between adjacent delivery devices for manually engaging and separating one delivery device from the other. Preferably, each separable portion is selected from the group including (i) a frangible portion, (ii) a sealing portion defining a reduced seal thickness in comparison to contiguous sealing portions, and (iii) a relatively weak wall portion. Preferably, each device further includes a dispensing port in fluid communication with the first and/or second chambers, and a fourth sealing member movable between a closed position sealing the respective dispensing port, and an open position allowing the first and second substances to flow through the respective dispensing port.

In some embodiments of the present invention, the first and/or second penetrable and thermally resealable portions are formed by one or more stoppers located on the body. Preferably, the stopper is coupled to the body by one or more of (i) co-molding the stopper and body, (ii) over-molding the stopper and/or body to the other, (iii) thermally sealing the stopper and/or body to the other, and (iv) adhesively attaching the stopper and/or body to the other.

In some embodiments of the present invention, the first chamber includes therein a medicament, and the second chamber includes therein a food and/or beverage. In one such embodiment, the food and/or beverage is non-medicated. In some such embodiments, the first and/or second chambers are substantially airless and/or are hermetically sealed with respect to the ambient atmosphere. Preferably, the form of the medicament is selected from the group including (i) a liquid, (ii) a powder, (iii) a gel, (iv) nano particles, and (v) gelules; and the form of the food and/or beverage is selected from the group including a liquid and a gel.

In some embodiments of the present invention, the first chamber includes therein a medicament and the second chamber includes therein a food and/or beverage. The food and/or beverage defines one or more of (i) a substantially predetermined pH selected to control at least one of absorption, residence time, transport and bioavailability of the medicament in a mammal, (ii) at least one predetermined medicament metabolizing enzyme, (iii) at least one predetermined medicament transporting enzyme, (iv) at least one predetermined flavor, and (v) a predetermined viscosity of the beverage combined with the medicament. In some such embodiments, the food and/or beverage (i) defines a substantially predetermined pH selected to control absorption of the medicament in a target tissue of a mammal, and/or (ii) is selected to substantially coat intestinal mucosa of a mammal to enhance tolerance and/or reduce irritability of the medicament.

In accordance with another aspect, the present invention is directed to a medicament delivery device comprising a body defining at least one first chamber including therein a medicament, and at least one second chamber including therein a food and/or beverage. A first sealing portion is located between the first and second chambers and is movable between a closed position preventing fluid communication between the first and second chambers, and an open position permitting fluid communication between the first and second chambers for mixing the medicament and the food and/or beverage when ready for use. A dispensing port is in fluid communication with the first and/or second chambers, and a sealing member is movable between a closed position sealing the dispensing port, and an open position allowing the medicament and the food and/or beverage to flow through the dispensing port.

In some embodiments of the present invention, the food and/or beverage defines one or more of (i) a substantially predetermined pH selected to control the absorption, residence time, transport and/or bioavailability of the medicament in a mammal, (ii) at least one predetermined medicament metabolizing enzyme, (iii) at least one predetermined medicament transporting enzyme, (iv) at least one predetermined flavor, and (v) a predetermined viscosity of the food and/or beverage combined with the medicament. In some such embodiments, the food and/or beverage (i) defines a substantially predetermined pH selected to control absorption of the medicament in a target tissue of a mammal, and/or (ii) is selected to substantially coat intestinal mucosa of a mammal to enhance tolerance of the medicament by, and/or reduce irritability of the medicament to, the mammal.

Preferably, the device further comprises a first penetrable and thermally resealable portion in fluid communication with the first chamber that is penetrable by an injection member to form an injection aperture therethrough, and introduce the first substance through the injection member and into the first chamber, and is thermally resealable to seal the injection aperture and the first substance within the first chamber by applying energy thereto. The device preferably further comprises a second penetrable and thermally resealable portion in fluid communication with the second chamber that is penetrable by an injection member to form an injection aperture therethrough, and introduce the second substance through the injection member and into the second chamber, and is thermally resealable to seal the injection aperture and the second substance within the second chamber by applying energy thereto. In some such embodiments, each of the first and second penetrable and thermally resealable portions is needle penetrable and laser resealable, and includes a thermoplastic that is pierceable with a needle to form a needle aperture therethrough, and is laser resealable to hermetically seal the needle aperture by applying laser radiation at a predetermined wavelength and power thereto.

In accordance with another aspect, the present invention is directed to a method comprising the following steps:

(i) providing a device comprising a body defining at least one first chamber and at least one second chamber, and further including a first sealing portion located between the first and second chambers, a first penetrable and thermally resealable portion in fluid communication with the first chamber, a second penetrable and thermally resealable portion in fluid communication with the second chamber, a dispensing port in fluid communication with the first and/or second chamber, and a sealing member movable between a closed position sealing the dispensing port and an open position;

(ii) introducing an injection member through the first penetrable and thermally resealable portion, introducing a first substance, such as a medicament, through the injection member and into the first chamber, withdrawing the injection member, and thermally resealing a resulting injection aperture in the first penetrable and thermally resealable portion and, in turn, sealing the first substance within the first chamber; and (iii) introducing an injection member through the second penetrable and thermally resealable portion, introducing a second substance, such as a food and/or beverage, through the injection member and into the second chamber, withdrawing the injection member, and thermally resealing a resulting injection aperture in the second penetrable and thermally resealable portion and, in turn, sealing the second substance within the second chamber.

In one embodiment of the present invention, the method further comprises the step of delivering a combination of a medicament and a food and/or beverage when ready for use by (i) moving the first sealing portion between a closed position and an open position and, in turn, placing the first chamber in fluid communication with the second chamber and mixing the medicament and the food and/or beverage, and (ii) moving the sealing member from the closed to the open position, and delivering the combination of the medicament and the food and/or beverage through the dispensing port.

In some embodiments of the present invention, the method further comprises forming at least one wall defining at least a portion of the first and/or second chambers of a flexible material, manually pressing the flexible material and causing the medicament and/or the food and/or beverage to exceed a threshold pressure that, in turn, causes the first sealing portion to move from a closed position to an open position.

In some embodiments of the present invention, the method further comprises the step of selecting the food and/or beverage to define one or more of (i) a substantially predetermined pH to control absorption, residence time, transport and/or bioavailability of the medicament in a mammal, (ii) at least one predetermined medicament metabolizing enzyme, (iii) at least one predetermined medicament transporting enzyme, (iv) at least one predetermined flavor, and (v) a predetermined viscosity of the beverage combined with the medicament. In some such embodiments, the method further comprises the step of selecting the food and/or beverage to define (i) a substantially predetermined pH to control absorption of the medicament in a target tissue of a mammal, and/or (ii) to substantially coat intestinal mucosa of a mammal to enhance tolerance of the medicament by, and/or reduce irritability of the medicament to, the mammal. In some such embodiments, the method further comprises the step of selecting the food and/or beverage based on the respective medicament to define a pH selected to achieve a substantially predetermined rate of absorption of the respective medicament in a mammal, a substantially predetermined residence time of the respective medicament in the stomach of the mammal, and a substantial tolerance of the respective medicament by the mammal.

In some embodiments of the present invention, the method further comprises forming the body of the device by providing first and second flexible sheets, and sealing at least one of the first and second flexible sheets to the other to define the first and second chambers therebetween. Preferably, the method further comprises filling the first and second chambers through the penetrable and thermally resealable portions, opposing pressing portions of the first and/or second sheets toward the other and, in turn, forming a plurality of first chambers located on opposite sides of the pressed portion relative to each other, and a plurality of second chambers located on opposite sides of the pressed portion relative to each other, and then sealing the pressed opposing portions to, in turn, prevent fluid communication between adjacent chambers. In one such embodiment, the method further comprises orienting the sheets substantially vertically during the stop of pressing. Preferably, the method further comprises substantially evenly distributing the filled medicament in adjacent first chambers, and the filled food and/or beverage in adjacent second chambers.

In some embodiments of the present invention, the method further comprises removing the penetrable and thermally resealable portions from the device after filling the first and second chambers therethrough.

One advantage of the currently preferred embodiments of the present invention is that the food and/or beverage can be selected to enhance or optimize the desired absorption and/or activity of the respective medicament. For example, the food and/or beverage can be selected to coat the gastric mucosa and provide the requisite pH to improve tolerance, efficacy and/or compliance in comparison to the prior art.

Yet another advantage of the currently preferred embodiments of the present invention is that the medicament and the food and/or beverage are maintained in separate chambers until ready for use. Accordingly, the problems encountered in mixing medicaments with foods and/or beverages at the time of manufacture or filling are substantially avoided. In addition, the medicament and the food and/or beverage can be mixed, if desired, immediately prior to use, and the combined medicament and food and/or beverage can significantly increase the absorption, transport, bioavailability and/or tolerance in comparison to taking the medicament itself.

Other objects and advantages of the present invention will become more readily apparent in view of the following detailed description of the currently preferred embodiments and the accompanying drawings.

DETAILED DESCRIPTION OF EMBODIMENTS OF THE INVENTION

Figure 1:
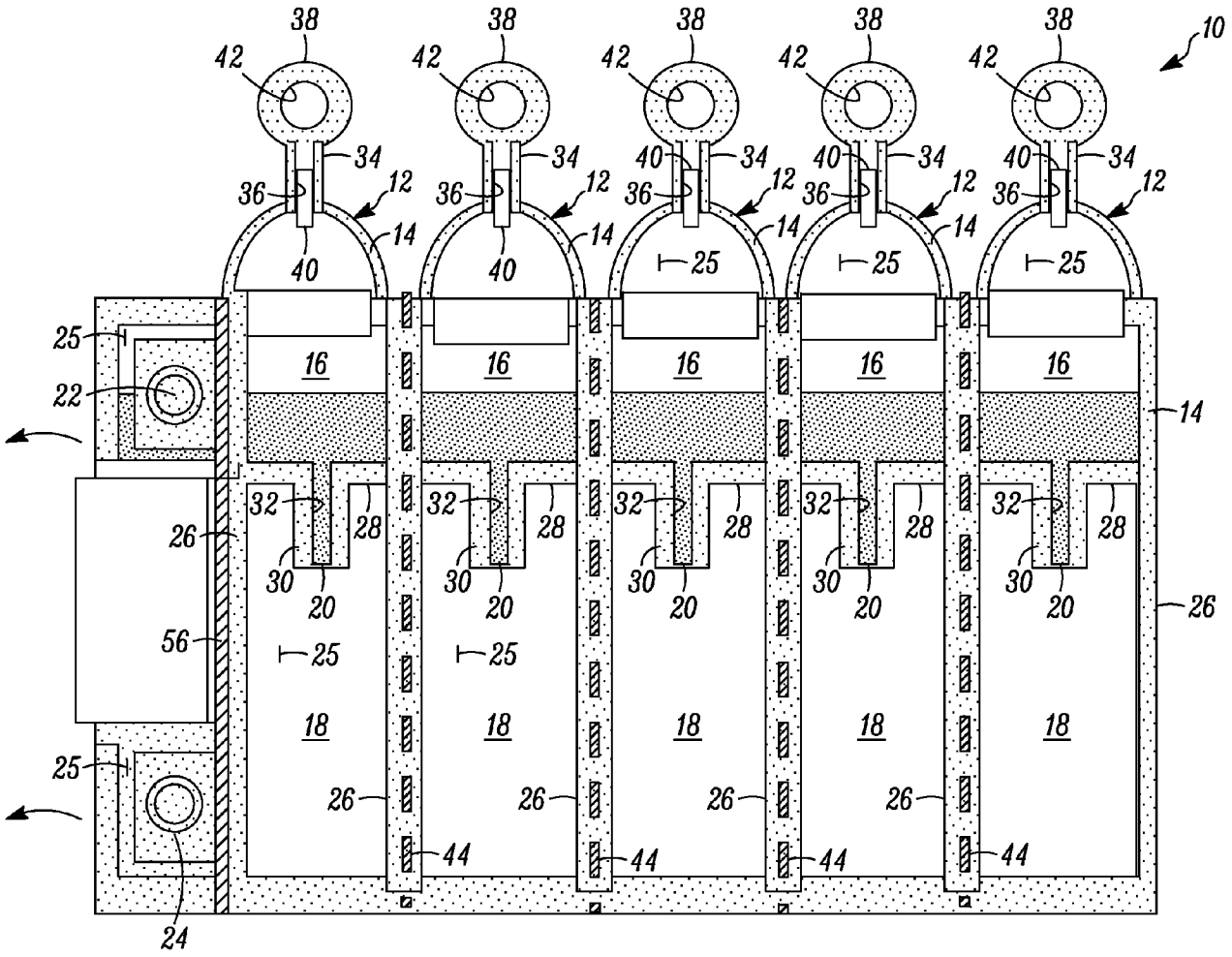
FIG. 1 is a side elevational view of a delivery device embodying the present invention comprising a plurality of frangibly interconnected delivery units, wherein each delivery unit includes a first chamber holding a medicament, a second chamber holding a food and/or beverage, a frangible seal between the first and second chambers that can be opened by squeezing the delivery unit to intermix the medicament and the food and/or beverage when ready for use, and a dispensing port for dispensing the mixture therethrough.

In FIG. 1 a delivery device embodying the present invention is indicated generally by the reference numeral 10. The device 10 comprises a plurality of individual delivery units 12 interconnected by frangible portions 14. Each delivery unit 12 includes a body 14 defining a first chamber 16 for receiving therein a first substance, and a second chamber 18 for receiving therein a second substance. A first sealing portion 20 is located between the first and second chambers 16 and 18, respectively. As described further below, the first sealing portion 20 is movable between a closed position preventing fluid communication between the first and second chambers 16 and 18, respectively, and an open position permitting fluid communication between the first and second chambers for mixing the first and second substances when ready for use.

During the manufacture of the device 10, and as described further below, a first penetrable and thermally resealable portion 22 is in fluid communication with the first chambers 16 and is penetrable by an injection member to form an injection aperture therethrough, and introduce the first substance through the injection member and into the first chambers 16, and is thermally resealable to seal the injection aperture and the first substance within the first chambers 16 by applying energy thereto. Also during the manufacture of the device 10, and as described further below, a second penetrable and thermally resealable portion 24 is in fluid communication with the second chambers 18 and is penetrable by an injection member to form an injection aperture therethrough, and introduce the second substance through the injection member and into the second chambers 18, and is thermally resealable to seal the injection aperture and the second substance within the second chambers 18 by applying energy thereto.

Each body 14 is defined by opposing walls 25. In the illustrated embodiment, and as described further below, each wall 25 is formed from a sheet of flexible plastic material that can be die cut and heat sealed, and is compatible with the substances to be contained therein. For example, in some embodiments of the present invention, the material forming the walls 25 does not leach an undesirable amount of leachables into the substances contained within the device, does not absorb an undesirable amount of active ingredients and/or other components from the substances contained within the device, and/or provides a requisite moisture and vapor transmission ("MVT") barrier. In one embodiment of the present invention, the material forming the walls 25 is a laminate of clear or substantially clear or translucent barrier plastic, such as an EVOH material. As may be recognized by those of ordinary skill in the pertinent art based on the teachings herein, the material forming the walls 25 of the device 10 may be any of numerous different materials or combinations of materials that are currently known or that later become known, and/or the walls may be formed of any of numerous different layers of materials that are currently known, or that later become known. In addition, the device 10 may be formed in accordance with any of numerous different manufacturing processes that are currently known or that later become known.

Each body 14 includes a second sealing portion or peripheral seal 26 extending about the periphery of the body and forming a fluid-tight seal between the interior and the exterior of the body. Each body 14 further includes a third sealing portion or interior seal 28 extending laterally through the body between the respective first chamber 16 and second chamber 18 and forming a fluid-tight seal therebetween. As can be seen, each third sealing portion 28 defines an axially-extending portion 30 having formed within it a channel 32 in fluid communication with the respective first chamber 16 and receiving therein a first substance from the first chamber. As also shown, each first sealing portion 20 is formed at the distal end of the respective axially-extending portion 30 and channel 32. In the illustrated embodiment, each first sealing portion 20 is defined by a frangible portion of the seal that is capable of being broken or is breakable. In the illustrated embodiment, the first sealing portion 20 defines a relatively reduced thickness in comparison to the adjacent portions of the third sealing portion 28, 30. As a result, and as described further below, when the opposing walls 25 of a respective body 14 are manually engaged and squeezed toward each other, the pressure within the first chamber 16 and/or the second chamber 18 will exceed a substantially predetermined threshold pressure that will cause the first sealing portion 20 to break or rupture, and thereby place the respective first chamber 16 in fluid communication with the respective second chamber 18 and allow intermixing of the first and second substances.

Each body 14 defines at its end opposite the respective second chamber 18 a dispensing port 34 defining a dispensing aperture 36 therein that is in fluid communication with the respective first chamber 16. Each body 14 further includes a respective fourth sealing portion or sealing member 38 formed at the end of the respective dispensing port 34 and forming a fluid-tight seal between the respective dispensing channel 36 and the ambient atmosphere. Each dispensing port 34 defines a frangible portion 40 formed approximately at the junction of the dispensing channel 36 and sealing member 38. As described further below, the respective sealing member 38 can be manually engaged and flexed or otherwise pulled away from the remainder of the body to, in turn, break the frangible portion 40 and open the dispensing port to release a mixture of the first and second substances therethrough. Each frangible portion 40 is capable of being broken, or is breakable, by manipulating the respective sealing member 38 such as by manual engagement. As may be recognized by those of ordinary skill in the pertinent art based on the teachings herein, the sealing member 38 may be connected to the body in any of numerous different ways, and/or the frangible portion 40 may be formed in any of numerous different ways, that are currently known, or that later become known. Each sealing member 38 defines an aperture 42 therethrough. As described further below, the aperture(s) 42 can be used to hold the device and/or manipulate the device during manufacture or thereafter.

The device 10 further comprises a plurality of frangible portions 44 extending axially between adjacent delivery units 12 that are breakable or capable of being broken in order to remove a respective delivery unit 12 from the device when ready for use. In the illustrated embodiment, each frangible portion 44 defines an axially-extending perforation that allows the respective delivery unit 12 to be separated from the device along a line defined by the perforation. As may be recognized by those of ordinary skill in the pertinent art based on the teachings herein, the frangible portions 44, or the mechanism for separating the delivery units 12 from the device 10, may take the form of any such mechanisms that are currently known, or that later become known.

In the illustrated embodiment of the present invention, the first substance located within the first chambers 16 is a medicament, and the second substance located within the second chambers 18 is a food and/or beverage. If desired, the food and/or beverage also may be medicated, or may be non-medicated. Also if desired, the first and/or second chambers may be substantially airless. Preferably, the form of the medicament is selected from the group including (i) a liquid, (ii) a powder, (iii) a gel, (iv) nano particles, and (v) gelules; and the form of the food and/or beverage is selected from the group including a liquid and a gel.

The food and/or beverage preferably defines one or more of (i) a substantially predetermined pH selected to control at least one of absorption, residence time, transport and bioavailability of the respective medicament in a mammal, (ii) at least one predetermined enzyme for metabolizing the respective medicament, (iii) at least one predetermined enzyme for transporting the respective medicament, (iv) at least one predetermined flavor, and (v) a predetermined viscosity of the food and/or beverage combined with the respective medicament. Preferably, the food and/or beverage (i) defines a substantially predetermined pH selected to control absorption of the respective medicament in a target tissue of a mammal, and/or (ii) is selected to substantially coat intestinal mucosa of a mammal to enhance tolerance and/or reduce irritability of the respective medicament.

As may be recognized by those of ordinary skill in the pertinent art based on the teachings herein, the medicament used in connection with the present invention may take the form of any substance or agent that is administered to promote recovery from an injury or ailment, or that treats or prevents or alleviates the symptoms of a disease, injury or ailment, such as any of numerous different medicines, medications or drugs, including without limitation any of numerous different vaccines, pharmaceuticals, ophthalmic, cosmeceutical, cosmetic and veterinary products that are currently known, or that later become known. Similarly, the foods and beverages used in connection with the present invention may take the form of any of numerous different foods and beverages that are currently known, or that later become known, including without limitation dairy products, such as milk, milk-based products, soy, soy-based products, fruit juices, fruit-juice based drinks, coffee, tea, soft drinks, and nutritional supplements.

Figure 2:
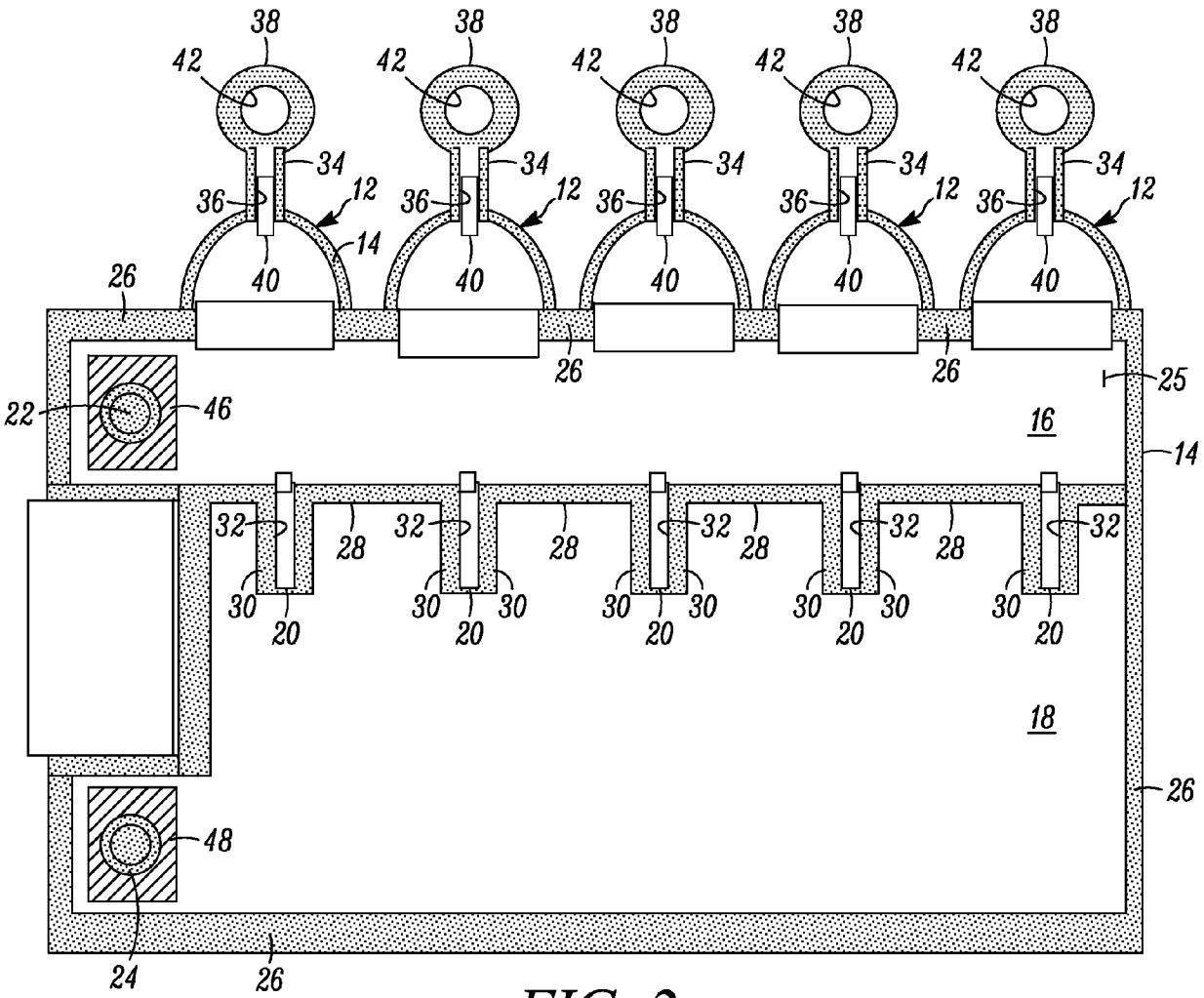
FIG. 2 is a side elevational view of the device of FIG. 1 prior to filling with the medicament and the food and/or beverage.

In order to manufacture the device 10, and as shown typically in FIG. 2, the sheets forming the opposing walls 25 of the device are superimposed over one another, and are compression sealed at predetermined locations to form various sealing portions of the device. In accordance with one embodiment of the present invention, there is no air or substantially no air between the opposing walls so that when the sheets are sealed at their peripheries the interior of the device 10 is substantially airless. Prior to and/or after compression sealing the excess portions of the sheets (not shown) are trimmed away or otherwise removed to form the peripheral shapes of the device. As shown typically in FIG. 2, the predetermined portions of the opposing walls 25 are compression sealed to form the second sealing portion or peripheral seal 26 extending about the periphery of the device, the third sealing portions or interior seals 28 extending laterally through the device between the first and second chambers 16 and 18, respectively, and defining the associated axially-extending sealing portions 30, the channels 32 formed therein, and the frangible first sealing portions 20, the fourth sealing portions or sealing members 38 and associated apertures 42 formed therethrough, and the dispensing ports 34 and associated dispensing channels 36 and frangible portions 40. Either prior to sealing, or after sealing, at least the interior portions of the device are sterile so that interior chambers 16 and 18 are sterile or aseptic to thereby maintain the substances filled therein in a sterile or aseptic condition and sealed with respect to the ambient atmosphere. Such sterility may be achieved by molding the device with sealed, empty sterile chambers; by assembling the opposing walls of the device promptly after molding or formation, such as by thermoforming, under a flow of sterile or aspect air, to maintain the sterility of the interior surfaces of the device; or by sterilizing the sealed, empty device in accordance with any of numerous different sterilizing processes that are currently known, or that later become known, such as by applying radiation, including for example gamma or e-beam radiation, or by a fluid sterilant, such as vaporized hydrogen peroxide ("VHP").

As also shown in FIG. 2, the first and second needle penetrable and laser resealable stoppers 22 and 24, respectively, are sealed to a respective wall 25 of the device such that the interior of the first stopper 22 is in fluid communication with the first chamber(s) 16 and the interior of the second stopper 24 is in fluid communication with the second chamber(s) 18. As shown in FIG. 2, the first stopper 22 is surrounded by a first stopper sealing portion 46 fixedly securing the first stopper to the respective wall and forming a fluid-tight seal therebetween, and the second stopper 24 is surrounded by a second stopper sealing portion 48 fixedly securing the second stopper to the respective wall and forming a fluid-tight seal therebetween. The compression seals are formed by opposing parts or halves of a compression die (not shown) that engage and compress the portions of the opposing walls 25 defining the sealing portions, and apply thermal energy thereto to fuse the opposing portions together to thereby form fluid-tight or hermetic seals. As may be recognized by those of ordinary skill in the pertinent art based on the teachings herein, the sealing portions of the device can be formed in any of numerous different ways that are currently known, or that later become known, such as by ultrasonic welding, adhesive bonding, chemical bonding, other types of fusing or welding processes, or alternatively, the device may be formed by thermoforming, injection molding, or any of numerous other processes for forming such devices that are currently known, or that later become known. Similarly, the needle penetrable and laser resealable stoppers 22 and 24 may be assembled to, or otherwise formed on the device in any of numerous other ways that are currently known, or that later become known, such as by over molding the stoppers to the respective wall or vice versa, otherwise co-molding the stoppers and body, adhesively attaching or otherwise bonding the stoppers to the body, or ultrasonic or other types of welding. As also may be recognized by those of ordinary skill in the pertinent art based on the teachings herein, the excess portions of the sheets may be trimmed away or otherwise removed in any of numerous different ways that are currently known, or that later become known, such as by die cutting, stamping, laser cutting, cutting with a blade, etc.

Figure 3:
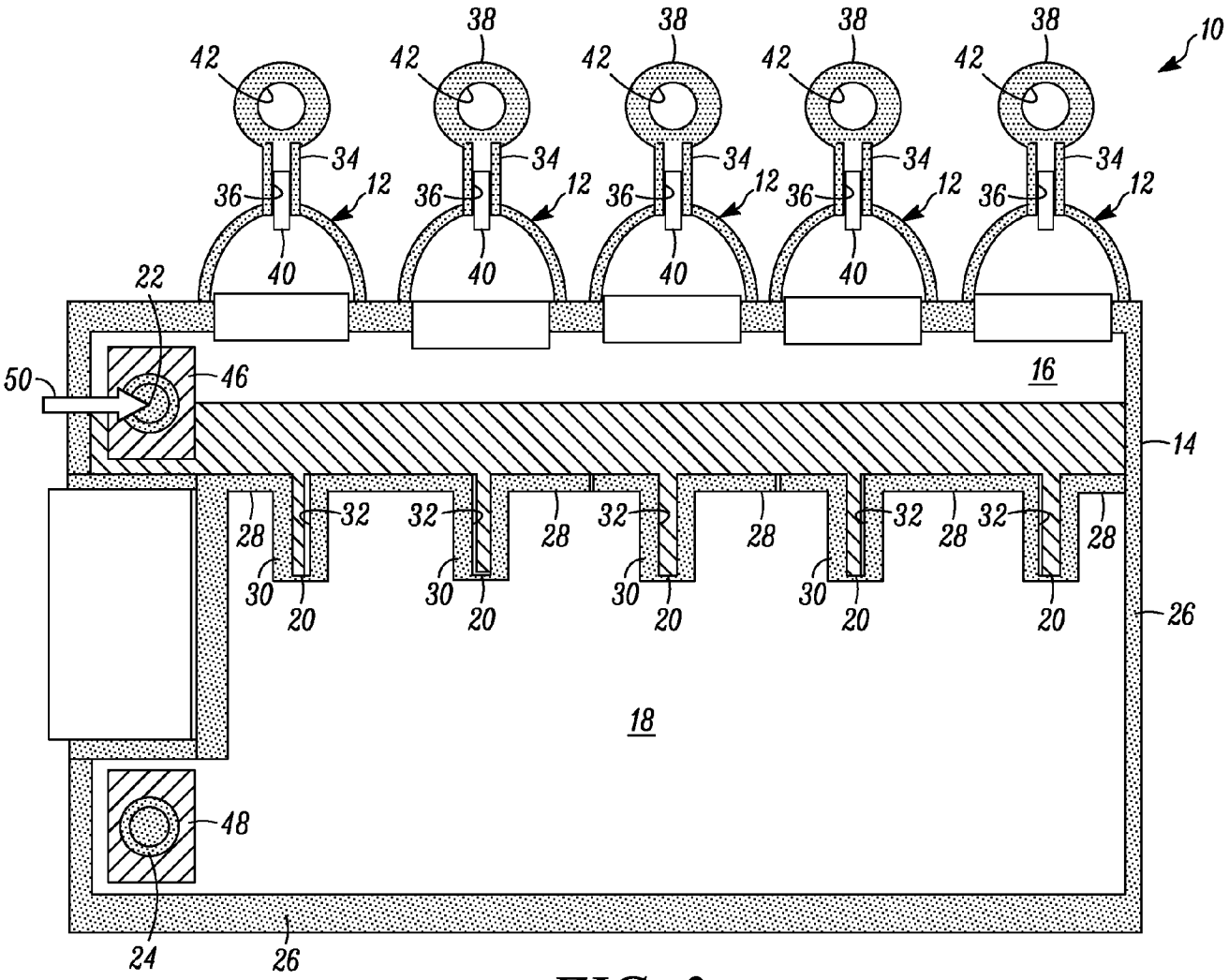
FIG. 3 is a side elevational view of the device of FIG. 2 after needle filling the device with the medicament and laser resealing the resulting needle hole in the respective needle penetrable and laser resealable stopper, but prior to being filled with the food and/or beverage.
Figure 4:
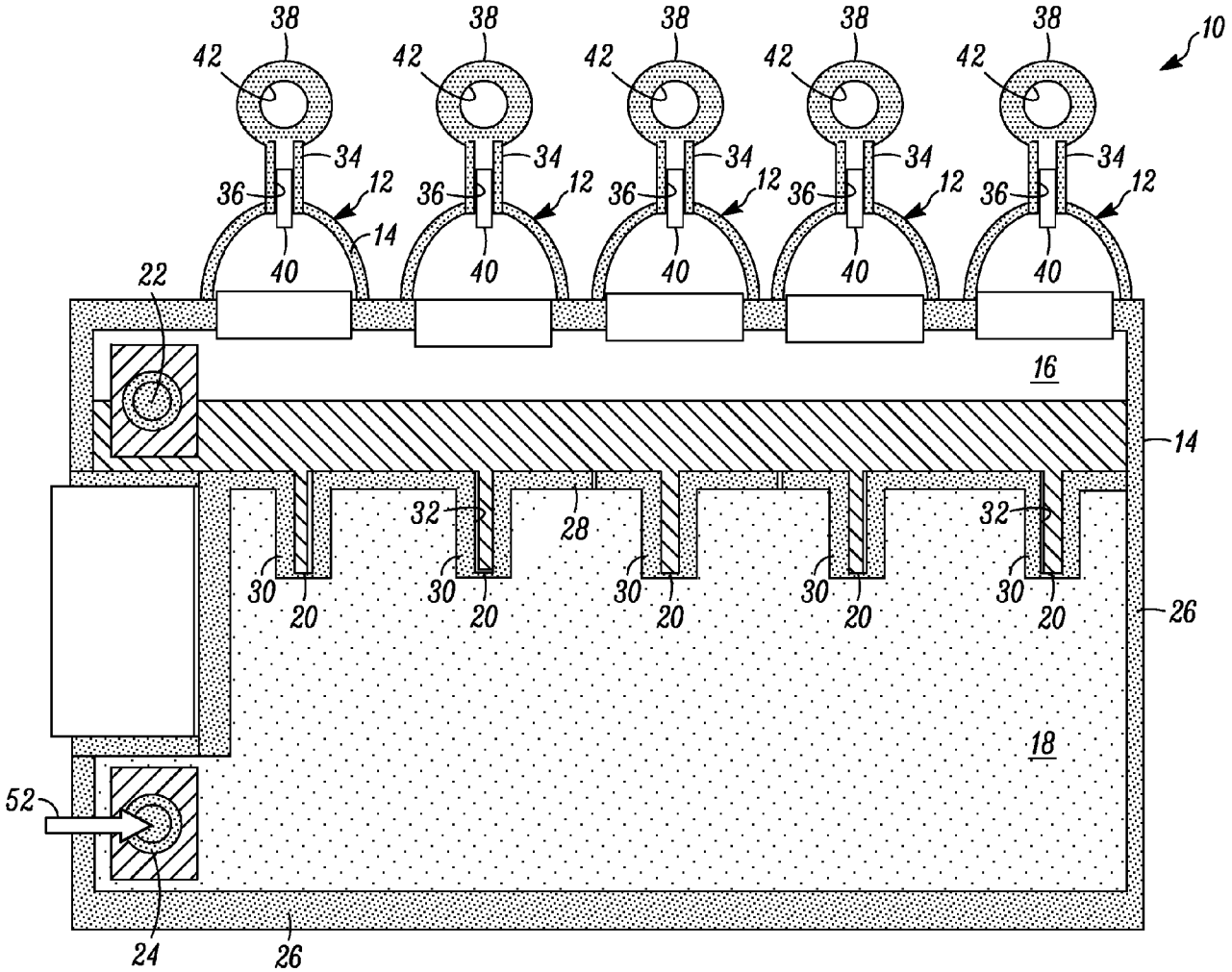
FIG. 4 is a side elevational view of the device of FIG. 3 after needle filling the device with the food and/or beverage and laser resealing the resulting needle hole in the respective needle penetrable and laser resealable stopper, but prior to separating the device into a plurality of frangibly interconnected delivery units.

As shown in FIG. 3, after forming the sealing portions and first and second chambers as described above in connection with FIG. 2, the external surfaces of the stoppers 22, 24, and the adjacent external surfaces of the device to the extent required or otherwise desired, are sterilized, such as by applying thereto radiation, such as e-beam or gamma radiation, or by applying thereto a fluid-sterilant, such as VHP. Then, the first stopper 22 is penetrated by a needle as shown schematically at 50 and a predetermined amount of the first substance, such as a medicament, is filled through the needle and into the first chamber(s) 16. After a predetermined amount of the first substance is introduced into the first chamber(s) 16, the needle 50 is withdrawn and the resulting needle hole in the stopper 22 is laser resealed to hermetically seal the first substance within the first chamber(s) 16. Then, as shown typically in FIG. 4, the second stopper 24 is penetrated by a needle as shown schematically at 52 and a predetermined amount of the second substance, such as a food and/or beverage, is filled through the needle and into the second chamber(s) 18. After a predetermined amount of the second substance is introduced into the second chamber(s) 18, the needle 52 is withdrawn and the resulting needle hole in the second stopper 24 is laser resealed to hermetically seal the second substance within the second chamber(s) 18.

Figure 5:
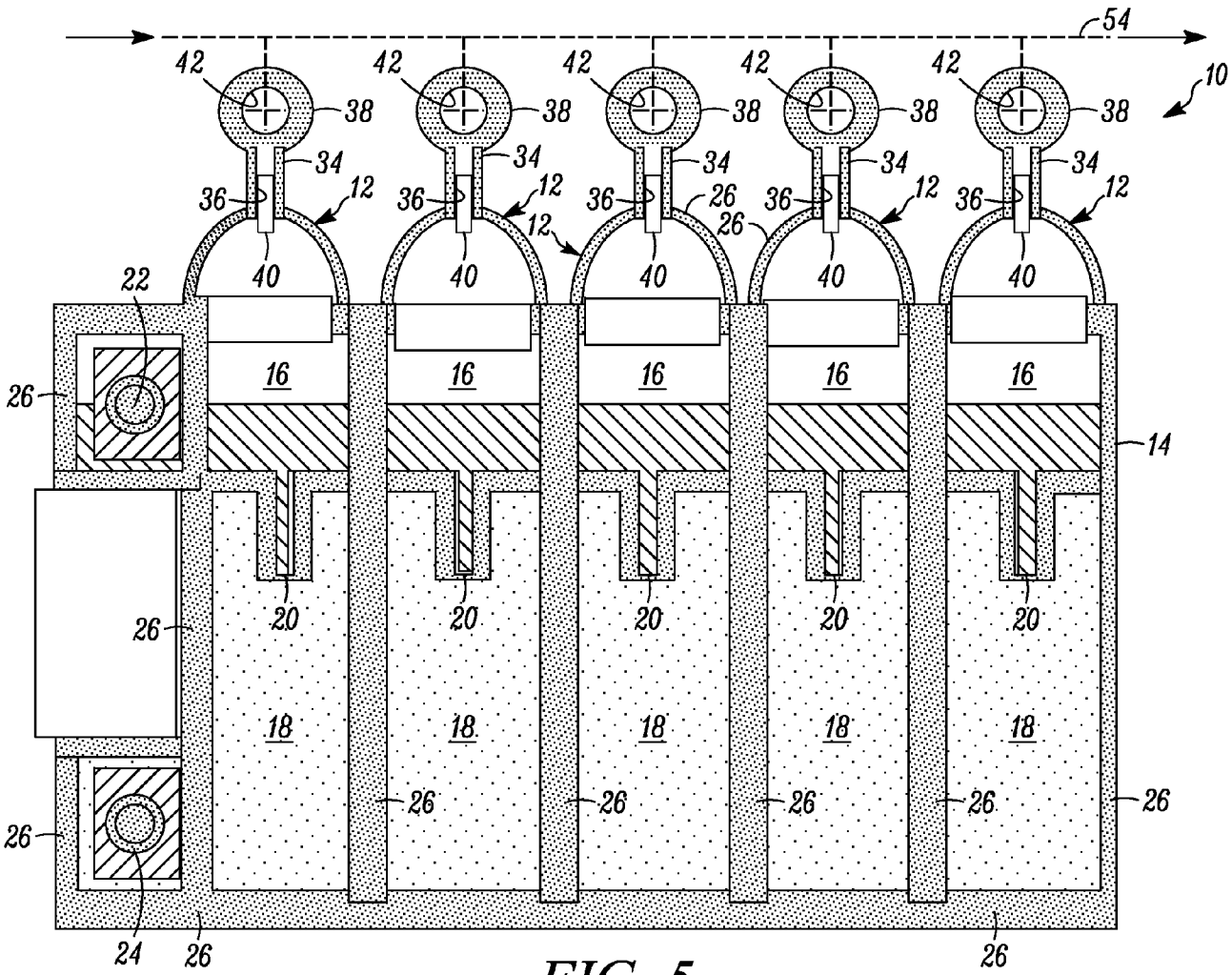
FIG. 5 is a side elevational view of the device of FIG. 4 after compression sealing the opposing side walls of the device to form a plurality of interconnected delivery units.

As shown in FIG. 5, after the device 10 is filled with predetermined amounts of the first and second substances, the device is divided into a plurality of individual delivery units 12 by forming the axially-extending portions of the peripheral seals 26 extending between adjacent delivery units, and the frangible portions 44 (FIG. 1) formed along the mid-portions of the respective axially-extending sealing portions 26. In one embodiment of the present invention, the device 10 is oriented substantially vertically during the step of forming the axially-extending sealing portions 26 in order to substantially evenly or uniformly divide the first and second substances between the first and second chambers 16 and 18, respectively. As shown in broken lines in FIG. 5, a conveying fixture 54 may be employed to hold the device at a plurality of the sealing member apertures 42 in a vertical orientation during the compression sealing of the axially-extending sealing portions 26. In one such embodiment, the opposing portions of the die (not shown) engage and compress the opposing walls 25 into engagement with each other to thereby form the axially-extending portions 26, and then the interior regions of the compressed portions are thermally fused to thereby form the axially-elongated fluid tight or hermetic seals. In one embodiment of the present invention, a sufficient distance is maintained between the thermally fused portions and the adjacent substance containing chambers 16 and 18 to ensure that the first and second substances are adequately insulated from the thermal energy to prevent any thermal damage thereto. The frangible portions 44 are formed through the axially-extending portions of the seals 26 either during the formation of the seals or thereafter. As may be recognized by those of ordinary skill in the pertinent art based on the teachings herein, the axially-extending portions 26 and frangible portions 44 may be formed in any of numerous different ways that are currently known, or that later become known. In addition, these sealing portions can be formed prior to filling the device 10 with the substance(s) rather than after filling the device with one or both substances. As indicated by the arrows in FIG. 5, the conveying fixture 56 moves the device through a sealing station. If desired, the same conveying fixture may be used to hold and transport the device through a needle filling and laser resealing station, or a different conveying mechanism can be used. As may be recognized by those of ordinary skill in the pertinent art based on the teachings herein, any of numerous different holding and/or conveying mechanisms that are currently known, or that later become known may be employed to hold and/or convey the devices of the present invention during the filling and/or formation thereof.

As indicated by the arrows in FIG. 1, the first and second stoppers 22 and 24 and associated portions of the opposing walls 25 are trimmed away or otherwise removed from the device 10 along a cut line 56. The device 10 is then ready for packaging and shipping. The cut line 56 may be formed by a die cut that may occur during the process of forming the axially-elongated sealing portions 26 and/or frangible portions 44, or that may occur thereafter. As may be recognized by those of ordinary skill in the pertinent art based on the teachings herein, the cut line 56 may be formed, and/or the needle penetrable and laser resealable stoppers may be removed from the device, in any of numerous different ways that are currently known, or that later become known.

Figure 6:
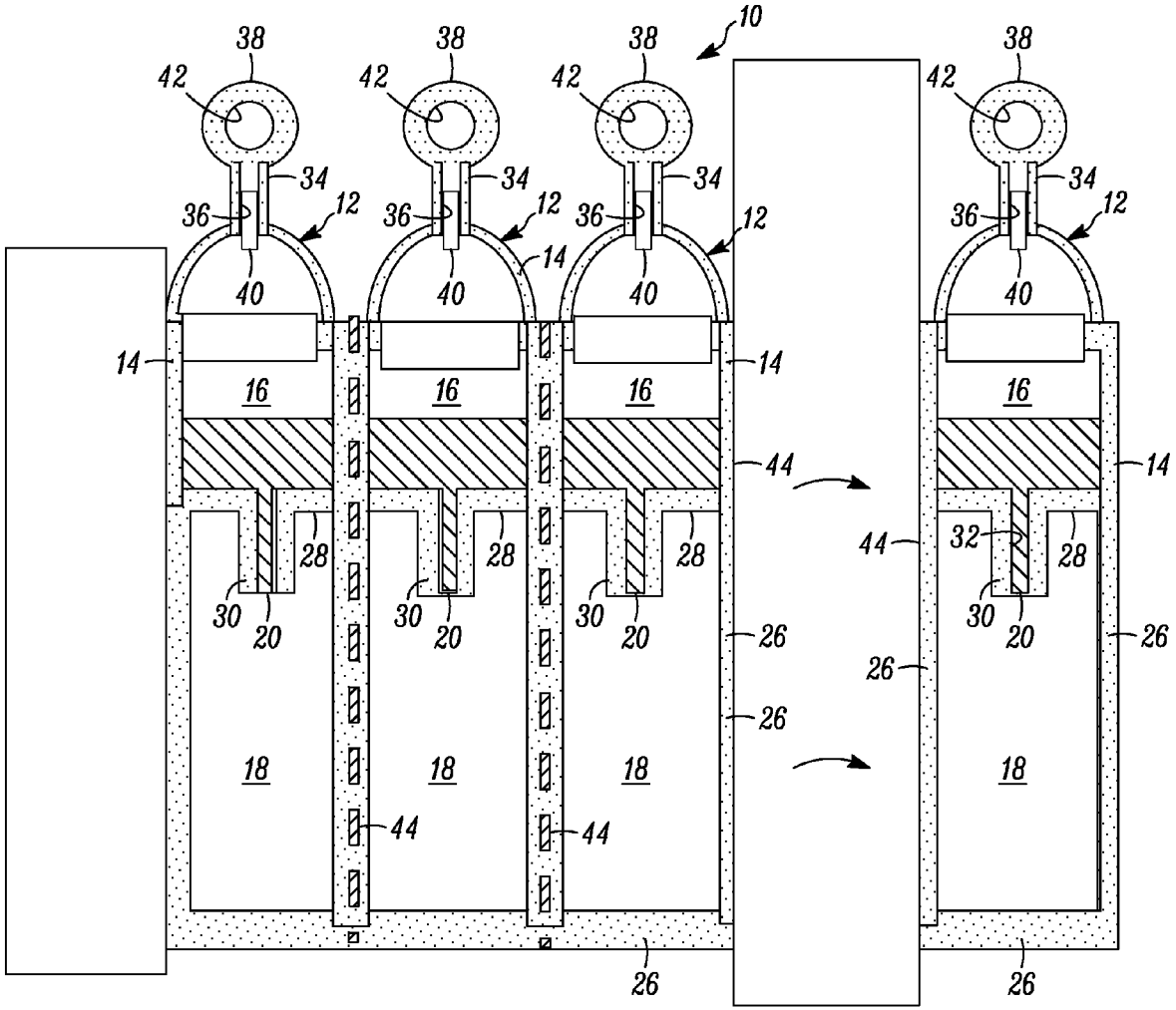
FIG. 6 is a side elevational view of the device of FIG. 5 after the needle penetrable and laser resealable stoppers are trimmed away or otherwise removed from the device, and showing an individual delivery unit removed from the device when ready for use.
Figure 7A:
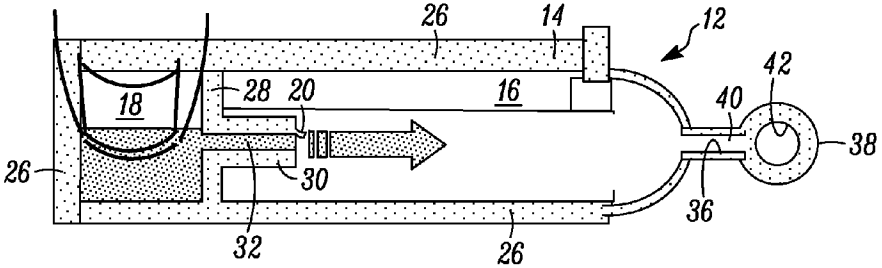
FIGS. 7A through 7C are a series of side elevational views of an individual delivery unit removed from the device as shown in FIG. 6, and showing in FIG. 7A the device being manually squeezed to break the seal between the medicament chamber and the food and/or beverage chamber, showing in FIG. 7B mixing of the medicament and the food and/or beverage, and showing in FIG. 7C oral ingestion of the medicament and food and/or beverage mixture through the dispensing port.
Figure 7B:
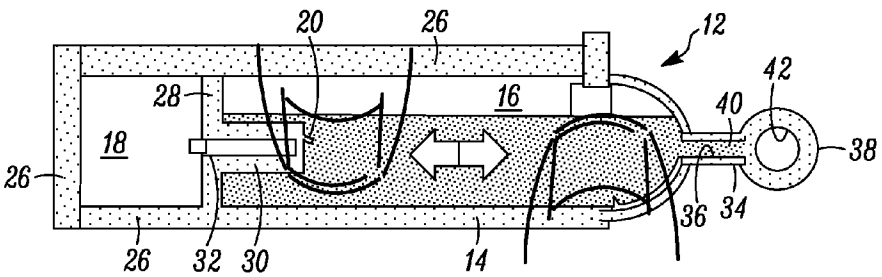
Figure 7C:
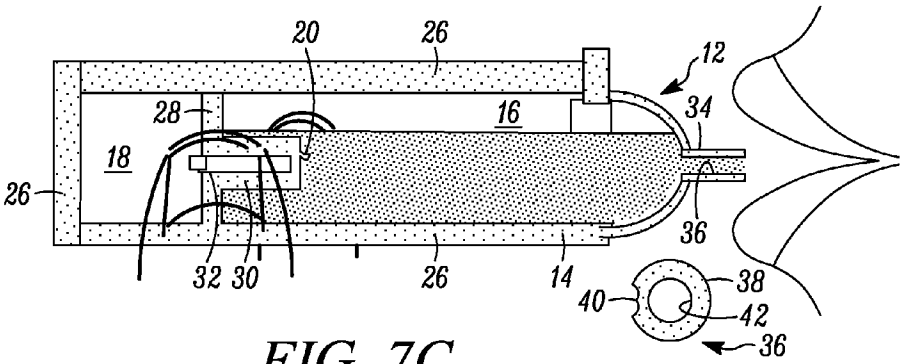

In the use of the device 10, and as shown typically in FIGS. 6 and 7, a user breaks away or otherwise removes the individual delivery units 12 from the device as needed. Accordingly, a user tears away or otherwise removes each delivery unit 12 from the device along the line of the respective frangible portion 44. Then, as shown in FIG. 7A, the user compresses the side walls 25 of the body 14 to, in turn, break the internal seal 20 and place the first and second chambers 16 and 18, respectively, in fluid communication with each other. If necessary, as shown typically in FIG. 7B, the user may shake and/or further squeeze the side walls of the respective delivery unit 12 to intermix the first and second substances. Then, as shown in FIG. 7C, the user manually breaks away the sealing portion 38 at the respective frangible portion 40 to expose the dispensing channel 36. As shown, the mixture of the first and second substances then may be orally ingested through the dispensing port 34. Preferably, each delivery unit 12 holds a "unit dose" of the desired first and second substances; however, as may be recognized by those of ordinary skill in the pertinent art based on the teachings herein, the delivery units 12 may hold any desired quantity of the first and/or second substances.

The needle penetrable and laser resealable stoppers 22 and 24 may be made, and the sterile, empty devices 10 may be needle filled and thermally resealed in accordance with the teachings of any of the following patent applications and patents that are hereby incorporated by reference in their entireties as part of the present disclosure: U.S. patent application Ser. No. 10/766,172 filed Jan. 28, 2004, entitled "Medicament Vial Having A Heat-Sealable Cap, And Apparatus and Method For Filling The Vial", which is a continuation-in-part of similarly titled U.S. patent application Ser. No. 10/694,364, filed Oct. 27, 2003, which is a continuation of similarly titled co-pending U.S. patent application Ser. No. 10/393,966, filed Mar. 21, 2003, which is a divisional of similarly titled U.S. patent application Ser. No. 09/781,846, filed Feb. 12, 2001, now U.S. Pat. No. 6,604,561, issued Aug. 12, 2003, which, in turn, claims the benefit of similarly titled U.S. Provisional Application Ser. No. 60/182,139, filed Feb. 11, 2000; similarly titled U.S. Provisional Patent Application No. 60/443,526, filed Jan. 28, 2003; similarly titled U.S. Provisional Patent Application No. 60/484,204, filed Jun. 30, 2003; U.S. patent application Ser. No. 10/655,455, filed Sep. 3, 2003, entitled "Sealed Containers And Methods Of Making And Filling Same"; U.S. patent application Ser. No. 10/983,178 filed Nov. 5, 2004, entitled "Adjustable Needle Filling and Laser Sealing Apparatus and Method; U.S. patent application Ser. No. 11/070,440 filed Mar. 2, 2005, entitled "Apparatus and Method for Needle Filling and Laser Resealing"; U.S. patent application Ser. No. 11/074,513 filed Mar. 7, 2005, entitled "Apparatus for Molding and Assembling Containers with Stoppers and Filling Same; U.S. patent application Ser. No. 11/074,454 filed Mar. 7, 2005, entitled "Method for Molding and Assembling Containers with Stoppers and Filling Same"; and U.S. patent application Ser. No. 11/339,966, filed Jan. 25, 2006, entitled "Container Closure With Overlying Needle Penetrable And Thermally Resealable Portion And Underlying Portion Compatible With Fat Containing Liquid Product, And Related Method"; and U.S. patent application Ser. No. 11/786,206, filed Apr. 10, 2007, entitled "Ready To Drink Container With Nipple And Needle Penetrable And Laser Resealable Portion, And Related Method".

In the event either the medicament, or the food or beverage is in a powder form, the powder is injected through the respective filling needle by using pressurized sterile air (such as filtered air) or other gas to push the powder through the needle and into the respective chamber. If necessary, the needle may include a vacuum port, or a separate vacuum needle may be employed, to evacuate any such sterile air that enters the respective chamber of the device. Alternatively, the needle may include one or more vent grooves, or otherwise may define one or more vent apertures between the needle and stopper to allow any such sterile air or gas that enters the respective chamber to vent therethrough.

If desired, the stopper or stoppers may be molded in the same mold as the body, or may be molded in adjacent molding machines, and at least one of the stopper(s) and the body may be assembled within or adjacent to the mold in accordance with the teachings of U.S. patent application Ser. Nos. 11/074,454 and 11/074,513 incorporated by reference above, and/or U.S. Provisional Patent Application Ser. No. 60/727,899 filed Oct. 17, 2005, entitled "Sterile De-Molding Apparatus And Method", and/or U.S. patent application Ser. No. 11/374,522 filed Mar. 13, 2006, entitled "Sterile De-Molding Apparatus and Method, each of which is hereby expressly incorporated by reference as part of the present disclosure. One advantage of this approach is that the device is closed to define sealed, empty sterile internal chambers at essentially the time of formation, and the device is never opened (through filling, resealing, and during shelf life) until the product is dispensed. Accordingly, a significantly high level of sterility assurance can be achieved.

As may be recognized by those of ordinary skill in the pertinent art based on the teachings herein, the first sealing portion may take the form of any of numerous different sealing portions that are currently known or that later become known. For example, the first sealing portion may take the form of any of numerous different frangible constructions that are currently known or that later become known, may otherwise define a reduced seal thickness in comparison to contiguous sealing portions, or may otherwise define a relatively weak wall portion. Alternatively, the first seal portion may take the form of a stopper or other sealing member received within an aperture connectable in fluid communication between the first and second chambers. When the stopper or other sealing member is received within the aperture, it seals the first and second chambers from each other. However, the stopper may be movable out of the aperture and into the first and/or second chamber to, in turn, place the first and second chambers in fluid communication with each other and allow intermixing of the first and second substances. In one such embodiment, the stopper or other sealing member facilitates mixing of the first and second substances after being released from the aperture and due to its movement within the first and/or second chamber.

One advantage of the currently preferred embodiments of the present invention is that they can provide sealed first and second chambers (or additional chambers if desired) that are sterile, such as by being molded as a sealed, empty sterile device, and/or by the application thereto of radiation, fluid sterilant, etc., that can be aseptically or sterile filled at virtually any desired temperature (e.g., at room temperature or at warmer or colder temperatures), such that medicaments or drugs and foods or beverages can be filled into the same device. The device, and related needle or other injection member and laser or other thermal resealing, allow medicaments or drugs and foods or beverages to be filled in the same sterile environment without the need to use, for example, sterile isolators, as encountered in the prior art. The methods and apparatus of the invention allow first and second substances to be filled without contact with the external environment, and without contact with each other, thus allowing sterile or aseptic filling, and preventing any cross-contamination of, or between the first and second substances.

Yet another advantage of the currently preferred embodiments of the present invention is that they can enable optimized pH and local enzymatic metabolisms that can be critical for absorption and activity of specific drugs. Yet another advantage of the currently preferred embodiments of the present invention is that they can enable faster drug absorption, and shorter residence time in the stomach and/or intestine. Yet another advantage of the currently preferred embodiments of the present invention is that they can enable coating of the gastric mucosa with, for example, a pH specific vehicle to improve drug tolerance, efficacy and compliance, especially, for example, in children and elderly patients.

A further advantage of the currently preferred embodiments of the present invention is that the devices can be closed (or the chambers sealed) and formed sterile, or sterilized at the time of formation or thereafter, but prior to filling. For example, the components of the device can be molded in the same mold or in adjacent molds within a sterile or aseptic environment so that the device is sealed sterile at the time of formation. The devices can then be pierced with a non-coring needle or other injection member without particle formation or release into the chambers, and re-sealed with a laser or other thermal or radiation source. The plural chambers can be filled in the same needle filling and laser resealing machine, or can be filled in separate machines. For example, the drug or medicament chambers can be filled in a first machine, and the food and/or beverage chambers can be filled in a second machine. Alternatively, the medicament/drug and food/beverage can be filled in the same machine by different needles or other injection members. The chambers of the device are sterile and protected by the sealed device from contamination throughout the manufacturing processes such that the devices themselves function as "isolators". As a result, there is no need to use sophisticated or complex isolators and sterile transfer ports during the filling process as encountered in the prior art.

As may be recognized by those of ordinary skill in the pertinent art based on the teachings herein, any of numerous different substances that are currently known, or that later become known, in any of numerous different forms (e.g., liquids, powders, gases, gels) can be used with the devices of the present invention. In one embodiment, the first substance is an analgesic, and the second substance is a food or beverage that increases the rate of absorption of the analgesic in an person over that of the analgesic itself. In another embodiment, the first substance is an anti-inflammatory, and the second substance is a food or beverage that provides a protective formulation for the gastric mucosa. In another embodiment, the first substance is a medicament that was previously provided in the format of a relatively large pill that was difficult to swallow, or that was bitter in taste, and the second substance is a food or beverage that improves the taste profile of the medicament and thereby enhances administration and patient compliance. In another embodiment, the first substance is an oncology drug, and the second substance is a food or beverage that increases the rate of absorption over administration of the drug itself and provides a coating for gastric mucosa to enhance patient tolerance, reduce patient discomfort otherwise associated with intravenous administration, and improves efficacy.

Another advantage of the currently preferred embodiments of the present invention is that the first and second chambers are initially sealed with respect to each other, and include stoppers or like portions that are penetrable by a needle or like injection member and the resulting needle holes or thermally resealable such as by the application of laser energy thereto. As a result, the device, system and method of such embodiments of the present invention can meet current, and even more rigorous than current, regulatory requirements with respect to asepsis. One reason for this is that the first and second chambers are from the outset (prior to filling) sealed with respect to the ambient atmosphere and sterile, and at no time during processing is it necessary to expose the interior of any chamber to the ambient atmosphere. Another advantage is that there is no need to assemble a container closure within a sterile filling machine in contrast to applicable prior art. Yet another advantage is that first and second substances, such as medicaments on the one hand, and foods and/or beverages on the other hand, can be transferred sterile through the filling needles or like injection members into the chambers without any exposure thereof to ambient atmosphere. A still further advantage is that if desired foods and beverages can be sterile filled into the same devices as medicaments, at the same time or at about the same time if desired, in the same filling machine, in a manner that satisfies the regulatory requirements for both medicaments on the one hand, and foods and beverages on the other hand.

As may be recognized by those skilled in the pertinent art based on the teachings herein, numerous changes and modifications may be made to the above-described and other embodiments of the present invention without departing from its scope as defined in the appended claims. For example, the stoppers, walls and other components of the device may be made of any of numerous different materials that are currently known, or that later become known for performing their functions and/or depending on the device application(s), including the products to be stored within the device. In one example, the penetrable and thermally resealable material may be blended with any of numerous different materials to obtain any of numerous different performance objectives. For example, any of the thermoplastic elastomers described in the patent applications incorporated by reference above may be blended with, for example, small beads of glass or other inert beads or particles to enhance absorption of the laser radiation and/or to reduce or eliminate the formation of particles when needle penetrated. In addition, beads or particles of the thermally resealable material may be blended with a cross-linked elastic material to thereby form a material blend that is both needle penetrable and thermally resealable, and that does not leach more than a predetermined amount of leachables into the product stored within the respective chamber. In addition, the device may take any of numerous different shapes and/or configurations, and may be adapted to receive and store within the chambers any of numerous different substances or products that are currently known or that later become known, including without limitation, any of numerous different foods and beverages, including low acid or fat containing liquid products, and any of numerous different medicaments. In addition, the products filled within the device may take any of numerous different forms, including liquid, gaseous, powdered, and semi-solid products. The device also may include any desired number of chambers, and any desired number of needle penetrable and thermally resealable stoppers or other portions for filling such chambers. For example, a single needle penetrable and thermally resealable portion may be in fluid communication with more than one chamber and used to fill such plural chambers. Alternatively, each delivery unit may include its own respective needle penetrable and thermally resealable portion for needle filling each delivery unit separately. In addition, the devices need not be limited to use with products that are enterally ingested. For example, the delivery units may include parenteral products, such as injectable vaccines or pharmaceuticals. In one such example, each delivery unit is in the form of a vial that includes a portion that is needle penetrable to remove the respective injectable product therefrom. In another embodiment, each delivery unit includes a Leur™ Lock or like fixture for connecting the respective delivery unit to a syringe for removing the substance or substances therefrom into a syringe for delivery by syringe injection. In these embodiments, each delivery unit may include only one chamber holding the respective injectable product rather than plural chambers. Accordingly, this detailed description of preferred embodiments is to be taken in an illustrative, as opposed to a limiting sense.

What is claimed is:

1. A method comprising:

filling a device including a body defining at least one first chamber that is empty and sealed from the ambient atmosphere for receiving therein a first substance, and at least one second chamber that is empty and sealed from the ambient atmosphere for receiving therein a second substance;

at least one first sealing portion extending between the at least one first and second chambers in a closed position preventing fluid communication between the at least one first and second chambers, and transformable from the closed position to an open position permitting fluid communication between the at least one first and second chambers for mixing the first and second substances;

a first penetrable and resealable portion in fluid communication with only the at least one first chamber and defining a hermetic seal between the at least one first chamber and the ambient atmosphere, wherein the first penetrable and resealable portion is penetrable by an injection member to form an injection aperture therethrough to aseptically introduce the first substance through the injection member and into the at least one first chamber while maintaining the hermetic seal between the at least one first chamber and the ambient atmosphere, and is resealable to hermetically seal the injection aperture and the first substance within the at least one first chamber; and a second penetrable and resealable portion in fluid communication with only the at least one second chamber and defining a hermetic seal between the at least one second chamber and the ambient atmosphere, wherein the second penetrable and resealable portion is penetrable by an injection member to form an injection aperture therethrough to aseptically introduce the second substance through the injection member and into the at least one second chamber while maintaining the hermetic seal between the at least one second chamber and the ambient atmosphere, and is resealable to hermetically seal the injection aperture and the second substance within the at least one second chamber;

wherein the filling step includes introducing an injection member through the first penetrable and resealable portion;

aseptically introducing a first substance through the injection member and into the at least one first chamber while maintaining a hermetic seal between the at least one first chamber and the ambient atmosphere;

withdrawing the injection member;

resealing a resulting injection aperture in the first penetrable and resealable portion and, in turn, hermetically sealing the first substance within the at least one first chamber;

introducing an injection member through the second penetrable and resealable portion;

aseptically introducing a second substance through the injection member and into the at least one second chamber while maintaining a hermetic seal between the at least one second chamber and the ambient atmosphere;

withdrawing the injection member;

and resealing a resulting injection aperture in the second penetrable and resealable portion and, in turn, hermetically sealing the second substance within the at least one second chamber.

2. A method as defined in claim 1, wherein the first substance is a medicament and the second substance is one or more of a food, a medicament, or a beverage.

3. A method as defined in claim 1, wherein the device further includes at least one dispensing port in fluid communication with one or more of the at least one first or second chambers, and a sealing member transformable from a closed position sealing the dispensing port and an open position allowing flow through the dispensing port, and the method further comprises (i) transforming the at least one first sealing portion between the closed position and the open position, thereby placing the at least one first chamber in fluid communication with the at least one second chamber;

(ii) mixing the first and second substances;

(iii) transforming the sealing member from the closed to the open position; and (iv) flowing the mixed first and second substances through the dispensing port.

4. A method as defined in claim 3, wherein device includes at least one substantially flexible portion defining at least a portion of one or more of the at least one first chamber or the at least one second chamber, and step (i) includes pressing the at least one substantially flexible portion or manually squeezing the body and causing one or more of the first substance or the second substance to exceed a threshold pressure that, in turn, causes the first sealing portion to transform from the closed position to the open position.

5. A method as defined in claim 2, further comprising the step of selecting the one or more of a food, a medicament, or a beverage to define one or more of (i) a substantially predetermined pH to control one or more of absorption, residence time, transport or bioavailability of the medicament in a mammal, (ii) at least one predetermined medicament metabolizing enzyme, (iii) at least one predetermined medicament transporting enzyme, (iv) at least one predetermined flavor, or (v) a predetermined viscosity of the beverage combined with the medicament.

6. A method as defined in claim 2, further comprising the step of selecting the one or more of a food, a medicament, or a beverage to define one or more of (i) a substantially predetermined pH to control absorption of the medicament in a target tissue of a mammal, or (ii) to substantially coat intestinal mucosa of a mammal to one or more of enhance tolerance of the medicament by, or reduce irritability of the medicament to, the mammal.

7. A method as defined in claim 2, further comprising the step of selecting the one or more of a food, a medicament, or a beverage based on the respective medicament to define a pH selected to achieve a substantially predetermined rate of absorption of the respective medicament in a mammal, a substantially predetermined residence time of the respective medicament in a stomach of the mammal, and a substantial tolerance of the respective medicament by the mammal.

8. A method as defined in claim 1, further comprising forming the body by providing first and second flexible sheets, and sealing one or more of the first or second flexible sheets to the other to define the at least one first and at least one second chambers therebetween.

9. A method as defined in claim 8, further comprising sealing opposing portions of one or more of the first or second sheets to the other to define at least one sealed portion and, in turn, forming a plurality of said at least one first chamber located on opposite sides of the at least one sealed portion relative to each other, and a plurality of said at least one second chamber located on opposite sides of the at least one sealed portion relative to each other, and preventing fluid communication between adjacent first chambers and adjacent second chambers.

10. A method as defined in claim 9, further comprising orienting the sheets substantially vertically during the sealing step.

11. A method as defined in claim 9, further comprising, prior to said sealing step, evenly distributing the first substance in said at least one first chamber, and evenly distributing the second substance in said at least one second chamber.

12. A method as defined in claim 1, further comprising removing the first penetrable and resealable portion and the second penetrable and resealable portion from the device after completing said filling step.

13. A method as defined in claim 12, further comprising, prior to said removing step, preventing fluid communication between the first penetrable and resealable portion and the at least one first chamber and between the second penetrable and resealable portion and the at least one second chamber.

14. A method as defined in claim 1, wherein the steps of resealing the injection aperture in the first penetrable and resealable portion and resealing the injection aperture in the second penetrable and resealable portion comprise applying radiation or energy thereto.

15. A method as defined in claim 14, wherein said resealing steps include thermally resealing the injection aperture in the first penetrable and resealable portion and the injection aperture in the second penetrable and resealable portion by applying laser radiation or energy.

16. A method as defined in claim 9, wherein the sealing step includes forming a plurality of individual delivery units, each having one of said plurality of first chambers and one of said plurality of second chambers.

17. A method as defined in claim 16, further comprising one or more of (a) removing one of said individual delivery units from the device; or (b) separating one of said individual delivery units from an adjacent one of said individual delivery units.

18. A method comprising:

dispensing substance from a device including a body defining a plurality of first chambers each containing therein a first substance, and a plurality of respective second chambers each containing therein a second substance;

a plurality of first sealing portions, each extending between one of the first chambers and its respective second chamber in a closed position preventing fluid communication therebetween, and transformable from the closed position to an open position permitting fluid communication therebetween for mixing the first and second substances; and at least one second sealing portion, each extending between adjacent of said first chambers and adjacent of said second chambers and preventing fluid communication therebetween, wherein the at least one second sealing portion defines the plurality of first chambers located on opposite sides of the at least one second sealing portion relative to each other, and the plurality of second chambers located on opposite sides of the at least one second sealing portion relative to each other;

wherein the device defines a plurality of delivery devices, each delivery device including one of the plurality of first chambers, its respective second chamber, a respective one the plurality of first sealing portions; and a dispensing port in fluid communication with one or more of the respective first or second chambers thereof, and a third sealing portion transformable from a closed position sealing the respective dispensing port, and an open position allowing flow through the respective dispensing port; and further comprising a plurality of separable portions located between adjacent of said plurality of delivery devices adapted for separating said adjacent delivery devices from each other;

wherein the dispensing step includes separating one of said delivery devices from any adjacent delivery devices at a respective separable portion;

transforming the first sealing portion of said separated delivery device between the closed position and the open position, and placing the first chamber thereof in fluid communication with the second chamber thereof;

mixing the first and second substances;

transforming the third sealing portion of said separated delivery device from the closed to the open position; and flowing the mixed first and second substances through the dispensing port.

19. A method as defined in claim 18, wherein the step of transforming the first sealing portion includes pressurizing one or more of the first or second substances within its respective first or second chamber of said separated delivery device above a threshold pressure so as to, in turn, cause the first sealing portion to transform from the closed position to the open position.

20. A method as defined in claim 19, wherein the pressuring step includes squeezing or pressing one or more of the first or second chambers of the separated delivery device.

21. A method comprising:

filling a device including a body defining at least one empty first chamber closed to the ambient atmosphere prior to filling and fillable while closed to contain a first substance therein sealed from the ambient atmosphere, and at least one empty second chamber closed to the ambient atmosphere prior to filling and fillable while closed to contain a second substance different from the first substance therein sealed from the ambient atmosphere;

at least one first sealing portion extending between the at least one first and second chambers in a closed position preventing fluid communication between the at least one first and second chambers, and transformable from the closed position to an open position permitting fluid communication between the at least one first and second chambers for mixing the first substance and the second substance; and at least one dispensing port in fluid communication with one or more of the at least one first or second chambers, and at least one sealing member transformable from a closed position sealing the at least one dispensing port, and an open position allowing flow through the at least one dispensing port;

wherein the filling step includes filling the at least one first chamber with the first substance while closed and filling the at least one second chamber with the second substance while closed.

22. A method as defined in claim 21, wherein the device further includes a first penetrable and resealable portion in fluid communication with only the at least one first chamber and defining a hermetic seal between the at least one first chamber and the ambient atmosphere, wherein the first penetrable and resealable portion is penetrable by an injection member to form an injection aperture therethrough and aseptically introduce the first substance through the injection member and into the at least one first chamber, and is resealable to hermetically seal the injection aperture and the first substance within the at least one first chamber; and a second penetrable and resealable portion in fluid communication with only the at least one second chamber and defining a hermetic seal between the at least one second chamber and the ambient atmosphere, wherein the second penetrable and resealable portion is penetrable by an injection member to form an injection aperture therethrough and aseptically introduce the second substance through the injection member and into the at least one second chamber, and is resealable to hermetically seal the injection aperture and the second substance within the at least one second chamber;

wherein the step of filling the at least one first chamber includes introducing an injection member through the first penetrable and resealable portion;

aseptically introducing the first substance through the injection member and into the at least one first chamber while maintaining the hermetic seal between the at least one first chamber and the ambient atmosphere;

withdrawing the injection member; and resealing a resulting injection aperture in the first penetrable and resealable portion and, in turn, hermetically sealing the first substance within the at least one first chamber; and the step of filling the at least one second chamber includes introducing an injection member through the second penetrable and resealable portion;

aseptically introducing the second substance through the injection member and into the at least one second chamber while maintaining the hermetic seal between the at least one second chamber and the ambient atmosphere;

withdrawing the injection member; and resealing a resulting injection aperture in the second penetrable and resealable portion and, in turn, hermetically sealing the second substance within the at least one second chamber.

23. A method as defined in claim 22, further including forming a seal between the first penetrable and resealable portion and the at least one first chamber and preventing fluid communication therebetween, and forming a seal between the second penetrable and resealable portion and the at least one second chamber and preventing fluid communication therebetween.

24. A method as defined in claim 23, further including removing the first and second penetrable and resealable portions from the device without exposing a respective at least one first or second chamber to the ambient atmosphere.

25. A method as defined in claim 21, further including transforming the at least one first sealing portion from the closed position to the open position and mixing the first and second substances.

26. A method as defined in claim 25, wherein the transforming step includes pressurizing one or more of the first or second substances within its respective at least one first or second chambers above a threshold pressure so as to cause the at least one first sealing portion to transform from the closed position to the open position.

27. A method as defined in claim 26, wherein the pressurizing step includes squeezing or pressing one or more of the at least one first or second chambers.

28. A method as defined in claim 25, further including transforming the at least one sealing member from the closed position to the open position, and flowing the mixed first and second substances through the at least one dispensing port.

29. A method as defined in claim 21, wherein the at least one first chamber defines a plurality of first chambers;

the at least one second chamber defines a plurality of respective second chambers;

the at least one first sealing portion defines a plurality of first sealing portions, each extending between one of said plurality of first chambers and its respective second chamber and preventing fluid communication therebetween;

the at least one dispensing port defines a plurality of dispensing ports, each in fluid communication with one of the plurality of first chambers, its respective second chamber, or both;

the at least one sealing member defines a plurality of sealing members, each adapted for sealing a respective one of said plurality of dispensing ports in its closed position;

the step of filling the at least one first chamber includes filling the plurality of first chambers;

the step of filling the at least one second chamber includes filling the plurality of second chambers; and the method further includes forming a second sealing portion extending between adjacent of said plurality of first chambers and adjacent of said plurality of second chambers and, in turn, preventing fluid communication between (i) adjacent first chambers located on opposite sides of the second sealing portion relative to each other and (ii) adjacent second chambers located on opposite sides of the second sealing portion relative to each other, and defining a plurality of delivery devices, each delivery device including one of the plurality of first chambers, its respective second chamber, a respective one the plurality of first sealing portions; a respective one of the plurality of dispensing ports, and a respective one of the plurality of sealing members.

30. The method of claim 29, further including forming separable portions between adjacent of said plurality of delivery devices adapted for separating said adjacent delivery devices.

31. The method of claim 30, further including separating said adjacent delivery devices from each other.

* * * * *